US009869074B2

(12) United States Patent
Andersson et al.

(10) Patent No.: US 9,869,074 B2
(45) Date of Patent: Jan. 16, 2018

(54) VALVE DEVICE

(75) Inventors: Bo Andersson, Jönköping (SE); Bertil Lundgren, Bjärtrå (SE)

(73) Assignee: NORDHYDRAULIC AB, Kramfors (SE)

( * ) Notice: Subject to any disclaimer, the term of this patent is extended or adjusted under 35 U.S.C. 154(b) by 774 days.

(21) Appl. No.: 13/378,396

(22) PCT Filed: Jun. 23, 2010

(86) PCT No.: PCT/SE2010/050718
§ 371 (c)(1),
(2), (4) Date: Dec. 15, 2011

(87) PCT Pub. No.: WO2010/151218
PCT Pub. Date: Dec. 29, 2010

(65) Prior Publication Data

US 2012/0085946 A1 Apr. 12, 2012

(30) Foreign Application Priority Data

Jun. 24, 2009 (SE) ..... 0900866

(51) Int. Cl.
*F15B 11/05* (2006.01)
*E02F 9/22* (2006.01)
*F15B 13/04* (2006.01)

(52) U.S. Cl.
CPC ..... *E02F 9/2267* (2013.01); *E02F 9/2232* (2013.01); *F15B 11/05* (2013.01);
(Continued)

(58) Field of Classification Search
CPC ..... F15B 11/05
(Continued)

(56) References Cited

U.S. PATENT DOCUMENTS 4,401,009 A * 8/1983 Zeuner et al. ..... 91/446
4,685,295 A 8/1987 Christiansen et al.
(Continued)

OTHER PUBLICATIONS

International Search Report for PCT/SE2010/050718.

*Primary Examiner* — F. Daniel Lopez
(74) *Attorney, Agent, or Firm* — Wenderoth, Lind & Ponack, L.L.P.

(57) ABSTRACT

The invention relates to a hydraulic valve device (1) including a high pressure connection (P') and a low pressure connection (T'); at least one motor port connection (A') that is connectable to a motor port (A) on a hydraulic motor (M), preferably a hydraulic cylinder; a flow control valve (F), which is arranged between the high pressure connection (P') and the motor port connection (A') and which includes a flow opening (18) that is adjustable between a fully closed position and a fully open position; and a pressure regulator (R) that is arranged between the high pressure connection (P') and the flow regulating valve (F), wherein a regulator pressure (PR) that acts at a first connection point (3) between the pressure regulator (R) and the flow regulating valve (F) acts on the pressure regulator (R) via a first control conduit (4) to close the same. A second control conduit (5) including a first restrictor (6), is arranged to convey a load pressure (PL) that acts at the motor port connection (A') from a second connection point (7) positioned between the flow regulating valve (F) and the motor port connection (A') via the first restrictor (6) to a third connection point (8) at which a first control pressure (Pc) acts and which third connection point (8) is connected to the pressure regulator (R) to act on the same in the opening direction by means of said first control pressure (Pc), wherein the third connection point (8) is connected to the low pressure connection (T), via an adjustable second restrictor (9).

12 Claims, 4 Drawing Sheets

(52) U.S. Cl.
CPC ..... *F15B 13/0417* (2013.01); *F15B 11/055* (2013.01); *F15B 2211/20553* (2013.01); *F15B 2211/30505* (2013.01); *F15B 2211/30535* (2013.01); *F15B 2211/5756* (2013.01); *F15B 2211/6051* (2013.01); *F15B 2211/6052* (2013.01); *F15B 2211/654* (2013.01)

(58) Field of Classification Search
USPC ..... 91/446
See application file for complete search history.

(56) References Cited

U.S. PATENT DOCUMENTS

| | | | | | |
|---|---|---|---|---|---|
| 4,981,159 | A | | 1/1991 | Christensen et al. | |
| 5,203,678 | A | * | 4/1993 | Sugiyama et al. | 91/446 |
| 5,440,967 | A | * | 8/1995 | Wennerbo | 91/446 |
| 5,680,762 | A | * | 10/1997 | Reid | 91/446 |
| 7,353,749 | B2 | | 4/2008 | Hamasagar | |

* cited by examiner

VALVE DEVICE

The invention relates to a valve device and specifically a valve device for use in a hydraulic system.

Hydraulic systems are used on mobile machines of different kinds in order to control the operation of the tools and functions of the mobile machines. In principle, there are two different types of valves for hydraulic control of such tools or functions; open-centre-valves and load sensing valves, which normally are denoted LS-valves.

Open-centre valves are mainly used in systems including a pump with a fixed displacement. The pump produces a constant flow and is often driven by a diesel motor with a predetermined constant rotational speed. When the valve that controls a tool is in a neutral position the hydraulic fluid passes through the "open centre" of the valve under low pressure back to the tank. If the valve is regulated in order to deliver a flow to a function, this will imply a simultaneous reduction of the flow through the open centre to a corresponding degree. The pump pressure used in open-centre valves is dependent of the load that has to be overcome in order to perform a desired function.

LS-valves on the other hand are mainly used in systems with pumps with a variable displacement. The displacement of the pump is continuously controlled by the valve system such that flows of desired magnitudes are attained to the different functions. As an alternative, the variable pump may be exchanged for a fixed pump and a so called load sensing bypass valve. Such a system involves a lower initial investment but higher operational costs due to greater energy losses. The invention is mainly intended for use in LS-systems.

PRIOR ART

In FIG. 1 a conventional LS-valve is shown, which is provided with a pressure regulator R. A pressure regulator is normally used in hydraulic systems to achieve better control of all the functions, to which a pump P is arranged to deliver a flow. A first pressure $P_{OC}$ acts via a first control conduit on a first side of the pressure regulator R. A second pressure $P_1$ acts on the other side of the pressure regulator R and corresponds to the pressure in the motor port of the work tool to which the pump P is connected. A spring S is arranged to act on the same side of the pressure regulator (the lower side in FIG. 1), wherein the spring force may be said to correspond to a pressure ΔP. The pressure drop over the control valve or the flow regulating valve F will hence constantly be equal to ΔP.

This performance implies that the flow through the control valve for a certain lever control position will be just as important regardless of the load. A conventional load sensing valve delivers a flow to the consumer that in each moment is proportional to the size of the opening of the flow regulating valve F. This flow is delivered even if the consumer cannot take up the flow. This is e.g. the case when the load has a high inertia. In that case it takes a comparatively long time to alter the velocity of the load. If the valve delivers a flow that is greater than the load port is able to receive, the pressure will increase and in the ideal case the pressure will increase in a single step, i.e. very rapidly. In practice the pressure increases until a pressure relief valve (not shown) opens and limits the pressure to a predetermined maximum value. The rapidly increasing pressure makes the load accelerate maximally such that the velocity of the load will increase. An ideal load sensing system is not suited for loads with great inertia or for functions where it is preferable to control the pressure rather than the flow. The governing of inertial loads by means of a load sensing valve implies that the governing becomes abrupt, since the acceleration is either null or maximal.

In U.S. Pat. No. 4,981,159, a pressure compensated LS-valve is described, in which a pressure regulator is utilized to continuously regulate a pressure difference in a different manner.

The pressure difference is the difference between the two pressures that act on opposing areas, wherein one of the areas is exposed to an additional force originating from a spring S. Hence, in principle, the difference in pressure corresponds to the force of the spring converted into to pressure, i.e. ΔP. The fact that the pressure regulator R is regulated in such a manner that a substantially constant pressure difference arises independent of the flow through the valve may then be used in different manners, e.g. in order to achieve a flow regulation.

In the conventional LS-valve that is shown in FIG. 1, this characteristic of the pressure regulator R is utilized to obtain a constant pressure drop over the inlet restrictor of the flow regulating valve. In U.S. Pat. No. 4,981,159, which is schematically represented in FIG. 2, this characteristic is instead utilized to achieve a constant flow through a restrictor 38. The restrictor 38 is typically very small in comparison to the restrictor of the flow regulating valve F, in the magnitude of a couple of percents. The regulated flow in FIG. 2 is hence substantially smaller than the maximum regulated flow in FIG. 1.

The regulated flow in FIG. 1 is utilized to obtain an accurate velocity control of the load connected to the valve. The substantially smaller flow in FIG. 2 is instead utilized to control the pressure of the pressure regulator by controlling the size of the restrictor 44 by means of the operator's lever control.

When the valve's lever control is in a neutral position the restrictor 44 is maximally open. The constant flow through the restrictor 38 may then pass the variable restrictor 44 at a low pressure drop. Hence, the pressure signal to the pressure regulator R corresponds to a low pressure. The pressure regulator R must therefore regulate its outlet pressure to a pressure that corresponds to that of the spring force. This pressure is normally in the range of 5-10 Bar. When the operator manoeuvres the valve, the variable restrictor 44 will be continuously closed as a function of the lever position. Therefore, the constant flow through the restrictor 38 will meet a greater resistance as it passes through the restrictor 44 to the tank T, and consequently the pressure $P_S$ in the signal conduit will increase. In correspondence, the regulated pressure of the pressure regulator will increase. The regulated pressure will become $P_S$ plus the pressure ΔP that corresponds to the spring force. The regulated pressure will hence in principle be fully independent of the flow that passes through the inlet restrictor to the load.

The relatively insignificant alteration from FIG. 1 to FIG. 2 implies that the flow regulating valve has obtained totally reversed properties. Instead of controlling the flow towards the load, the regulation has altered diametrically such that instead the pressure upstream of the inlet restrictor is controlled.

Both of the different valve devices are advantageous in specific, but different conditions and substantially less advantageous in other conditions. It is hence interesting to combine these properties depending on the actual conditions.

U.S. Pat. No. 7,353,749 describes a system, in which it in principle is possible to shift between the two systems in dependence of the actual conditions. The system is however relatively complicated and does not provide a fully satisfactory solution.

There is hence a need of a valve device that is relatively uncomplicated in its arrangement and that makes it possible to control a hydraulic system in a flexible manner in dependence of the actual conditions.

SHORT DESCRIPTION OF THE INVENTION

An object of the invention is to provide a valve device with relatively few included components that is able to control a flow in a hydraulic system in a flexible manner. This object is achieved by means of the valve device according to claim 1.

The invention relates to a hydraulic valve device including a high pressure connection and a low pressure connection; at least one motor port connection that is connectable to a motor port on a hydraulic motor, preferably a hydraulic cylinder; a flow control valve, which is arranged between the high pressure connection and the motor port connection and which includes a flow opening that is adjustable between a fully closed position and a fully open position; and a pressure regulator that is arranged between the high pressure connection and the flow regulating valve, wherein a regulator pressure acting at a first connection point between the pressure regulator and the flow regulating valve via a first control conduit acts on the pressure regulator in order to close the same. A second control conduit, including a first restrictor, is arranged to convey a load pressure that acts at the motor port connection from a second connection point positioned between the flow regulating valve and the motor port connection via the first restrictor to a third connection point where a first control pressure acts and which third connection point is in connection with the pressure regulator in order to act on the same in the opening direction by means of said first control pressure, wherein the third connection point is connected to the low pressure connection, via an adjustable second restrictor.

Advantageous embodiments of the invention are described in the detailed description and in the dependent claims.

SHORT DESCRIPTION OF THE DRAWINGS

DETAILED DESCRIPTION OF THE SHOWN EMBODIMENTS

Figure 1:
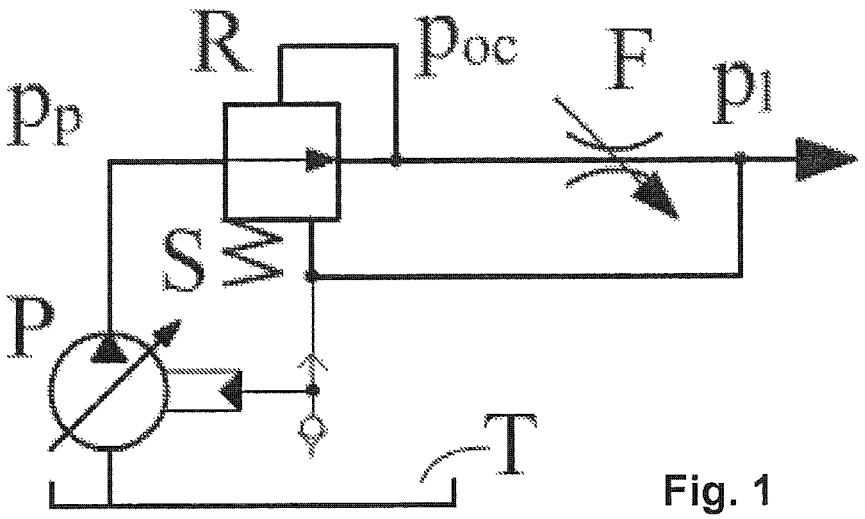
Fig. 1 Prior Art
FIG. 1 shows a conventional LS-valve according to the description above.
Figure 2:
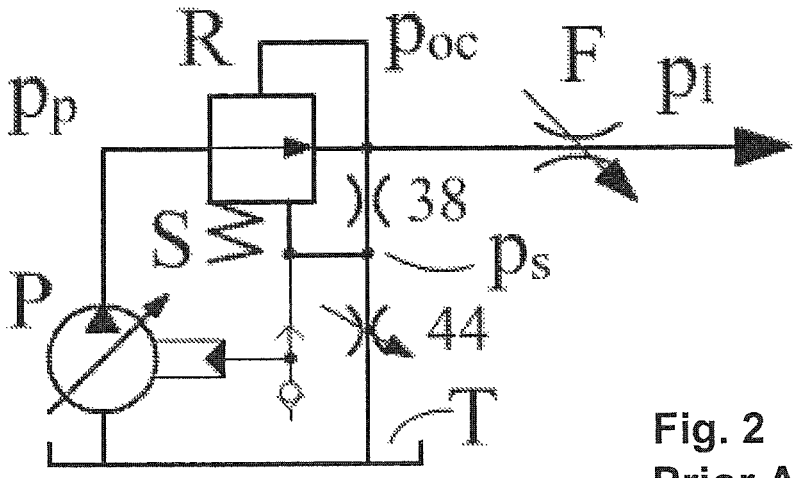
Fig. 2 Prior Art
FIG. 2 shows a conventional LS-valve for pressure control according to the description above.
Figure 3:
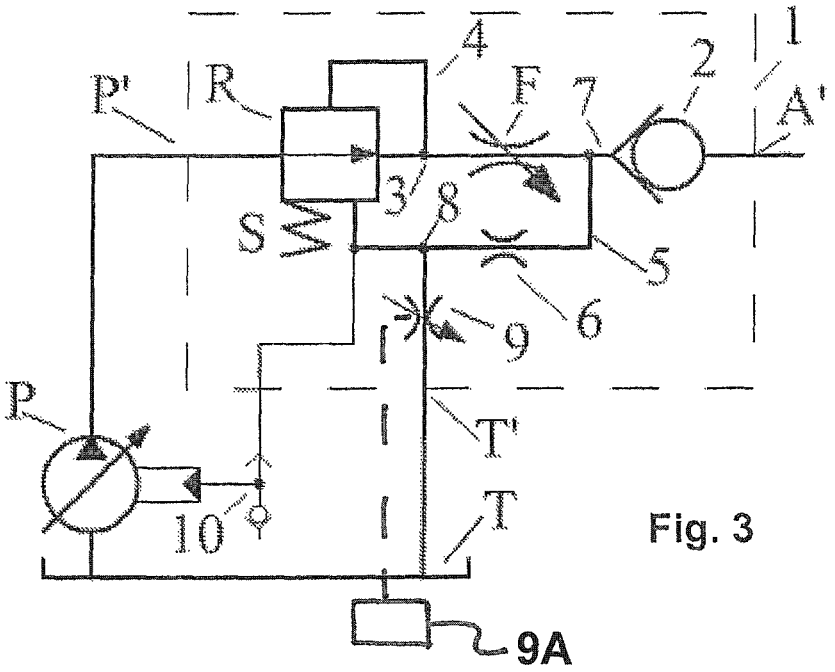
FIG. 3 shows a diagram of a valve device according to a first variant of the invention.

FIG. 3 illustrates a simplified diagram of a first embodiment of a valve device according to the invention. The valve device 1 includes a high pressure connection P', which is connected to a pressure source in form of a pump P, preferably a pump with a variable displacement. Further, the valve device 1 includes a low pressure connection T', which is connected to a low pressure tank T.

Figure 4:
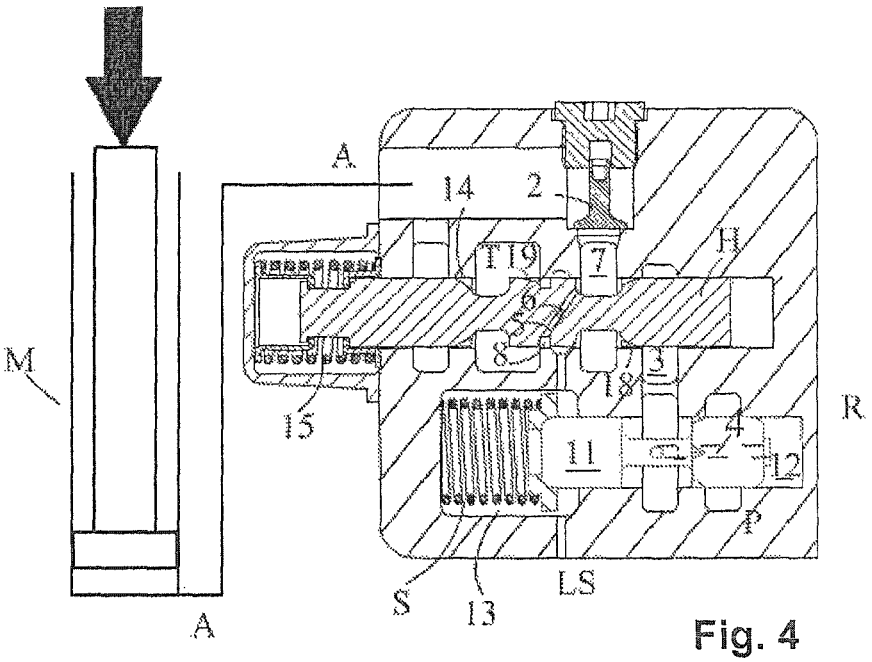
FIG. 4 shows a section of a specific embodiment of a valve device according to the first variant of the invention.

At the other end of the valve device 1 a motor port connection A' is arranged, which is connectable to a motor port A on a hydraulic motor M, which in the shown embodiment is illustrated by a single acting hydraulic cylinder (see FIG. 4). The invention is however not limited to the use of single acting hydraulic cylinders, but may on the contrary be advantageously used on other types of hydraulic motors such as e.g. double acting hydraulic cylinders, shaft driving motors, or the like.

A flow control valve F, also referred to as a flow regulating valve, is arranged between the high pressure connection P' and the motor port connection A', in order to regulate the flow towards the motor port connection A'. For this purpose the flow regulating valve F includes a flow opening that is adjustable between a fully closed position and a fully open position. The flow over the flow regulating valve F is proportional to the size of the flow opening but is also dependent of the pressure drop over the flow regulating valve, why the flow is dependent on the pressure both upstream and downstream of the flow regulating valve F. Preferably, a first non-return valve 2 is arranged downstream of the flow regulating valve F in order to prevent flow in the wrong direction, i.e. in the opposite direction to the pump flow. However, as alternatives, a non-return valve 2 may be placed at other locations.

A pressure regulator R is arranged between the high pressure connection P' and the flow regulating valve F in order to regulate the pressure upstream of the flow regulating valve F, which pressure is denoted regulator pressure PR and acts at a first connection point 3 located between the pressure regulator R and the flow regulating valve F. A first control conduit 4 is arranged to convey the regulator pressure PR to the pressure regulator R and to act on the same in the closing direction. Preferably, there is also a spring S arranged, which acts constantly on the pressure regulator R in the opening direction.

A second control conduit 5, which includes a first restrictor 6, is positioned between the flow regulating valve F and the motor port connection A'. The second control conduit 5 is arranged to convey the load pressure $P_L$, which acts at the motor port connection A', from a second connection point 7 via the first the restrictor 6 to a third connection point 8, where a first control pressure $P_C$ acts. The first restrictor 6 may advantageously be fixed and independent of the regulation of the flow regulating valve F.

The third connection point 8 is also connected to the pressure regulator R and acts on the same in the opening direction by means of said first control pressure $P_C$ and further, the third connection point 8 is connected to the low pressure connection T', via a second restrictor 9. The second restrictor 9 is preferably adjustably arranged, e.g. such that it is regulated in dependence of the flow regulating valve F and possibly the adjustable second restrictor 9 may be such arranged that the flow through area of the second restrictor 9 decreases when the flow through area of the opening of the flow regulating valve F towards the motor port connection A' increases.

The third connection point 8 is also in connection with a shuttle valve 10, which also receives the control pressure from other valve devices and conveys a control pressure to the pump P. The shuttle valve 10 is in a known manner arranged to convey the highest of the incoming control pressures to the pump P, such that the application that for the moment demands the highest pressure governs the pressure of the pump P.

Preferably, the second restrictor 9 may be such arranged that it is fully open when the flow regulating valve F is closed or just barely open, wherein it for a certain position of the flow regulating valve closes, such that it constitutes a restrictor that is continuously decreased as the flow regulating valve continuously opens. Such a performance implies that when the flow regulating valve F is opened to a low degree, the flow downstream will pass via the first restrictor 6 and the second restrictor 9 rather than to the motor port connection A', unless the pressure at the motor port connection A' is very low.

The adjustable second restrictor 9 may advantageously be arranged to be electrically regulated, as shown diagrammatically at 9A in FIG. 3. In this manner it is namely possible to customize the valve device 1 and its controls without having to adapt the production for each individual valve. This is due to the fact that the properties of the valve device to a great extent is actually controlled by the characteristics of the second restrictor 9. The different properties may be adapted to the specific application at which the valve device 1 is to be used, but also to special requirements of a specific operator. Further, it is possible through soft ware programming alone to change the properties of an already installed valve device. Hence, the usefulness of the valve device is ameliorated in that e.g. the valve device may be used in several different applications and that it may be adapted in a simple manner to several different special requirements of different specific operators.

Figure 5:
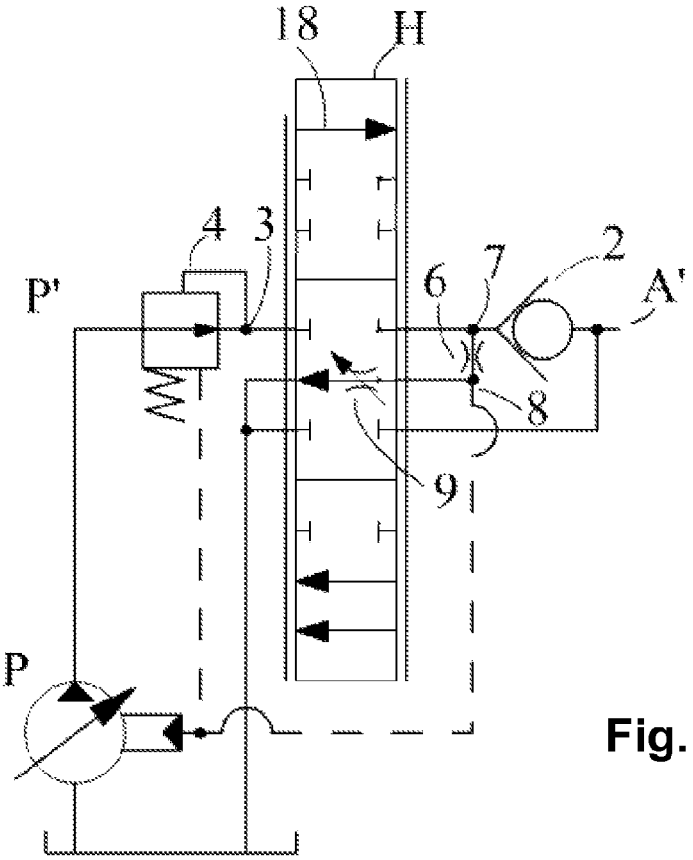
FIG. 5 shows a diagram of the specific embodiment that is shown in FIG. 4.

A first embodiment of the valve device 1 according to the diagram in FIG. 3 is shown in the longitudinal section in FIG. 4 and in FIG. 5 an alternative diagram for the same embodiment is shown. In FIGS. 4 and 5 the flow regulating valve F constitutes a part of a control valve with a valve spool H. The valve spool H is adjustable between three positions; a first closed position, which is shown in the figures and in which the flow from the high pressure connection P' is kept closed by the valve spool H, and two open positions. In the first open position, in which the valve spool H has been displaced to the right in FIG. 4 and downwards in FIG. 5, the flow regulating valve will open gradually and the hydraulic fluid may flow via a first flow opening 18, which is provided on the valve spool H and which connects both the outlet of the pressure regulator R and the first connection point 3 to the second connection point 7, from which a flow may flow past the non-return valve 2 as soon as the pressure in the second connection point 7 exceeds the load pressure $P_L$, which acts at the motor port connection A'. The first flow opening 18 mainly corresponds to the flow regulating valve F in FIG. 3.

Further, the second connection point 7 is in connection with a third connection point 8, via the first the restrictor 6. The adjustable second restrictor 9 is in the embodiment shown in FIG. 4 constituted by a second flow opening 19, of which the flow through area decreases gradually as the flow regulating valve F opens via the first flow opening 18 and as the valve spool H is displaced to the right.

In the shown embodiment, the pressure regulator R has a regulator spool 11 that is located in a valve body with three separate chambers: a right chamber 12, which is in control connection via the control conduit 4 with the first connection point 3; which connection point 3 constitutes a central chamber; and a left chamber 13, in which a spring S is arranged, which in conjunction with the pressure $P_C$ in the left chamber acts in the opening direction on the regulator spool 11, i.e. towards the right in FIG. 4.

A difference with respect to the diagram in FIG. 3 is that in FIGS. 4 and 5 it is illustrated how the cylinder chamber is emptied via the motor port A. When the valve spool is regulated towards the second open position, i.e. to the left in FIG. 4 and upwards in FIG. 5, diversion recesses 14 will connect the motor port connection A' to the low pressure connection T'. The more the valve spool H is displaced towards the second open position, the greater the flow opening through the diversion recesses 14 becomes.

To the left of the valve spool H in FIG. 4, a double acting spring arrangement 15 is arranged, which acts to keep the valve spool H in the closed central position shown in FIG. 4.

Figure 6:
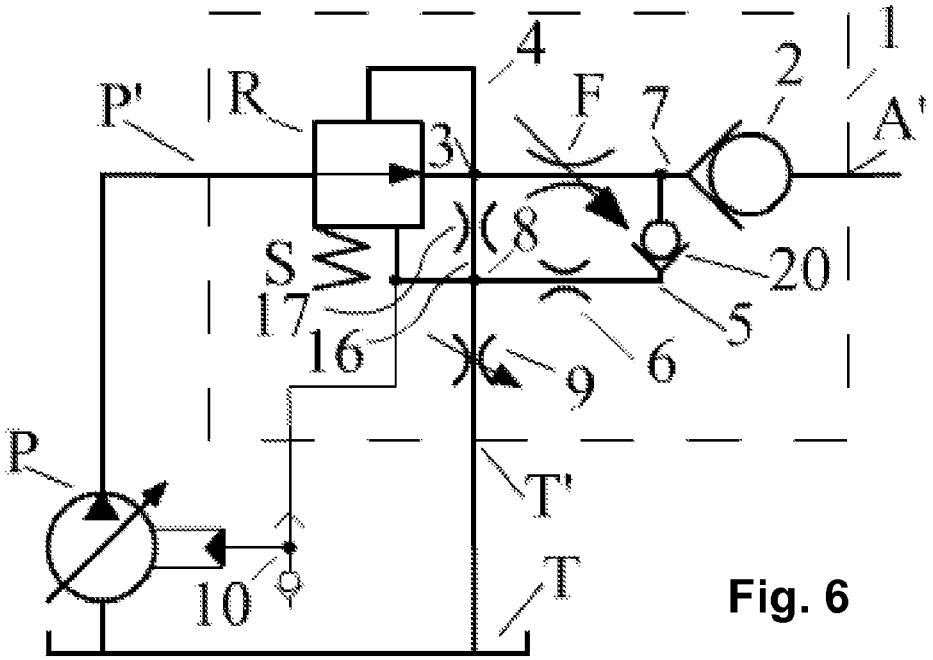
FIG. 6 shows a diagram of a valve device according to a second variant of the invention.
Figure 7:
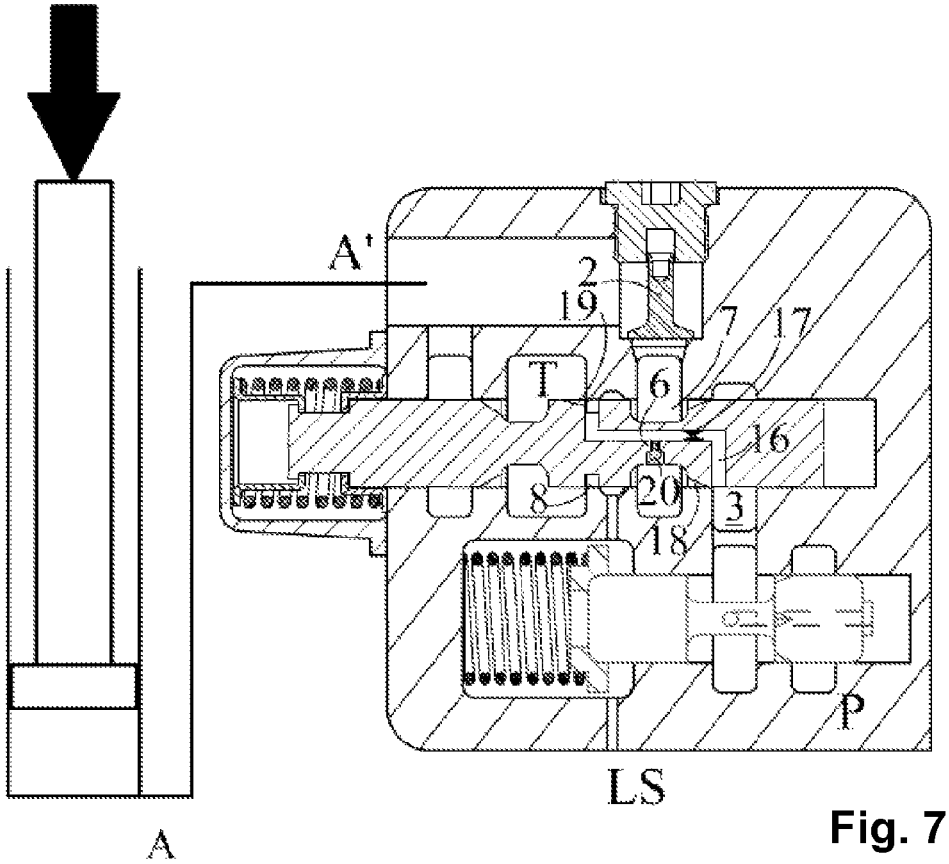
FIG. 7 shows a section of a specific embodiment a valve device according to the second variant of the invention.
Figure 8:
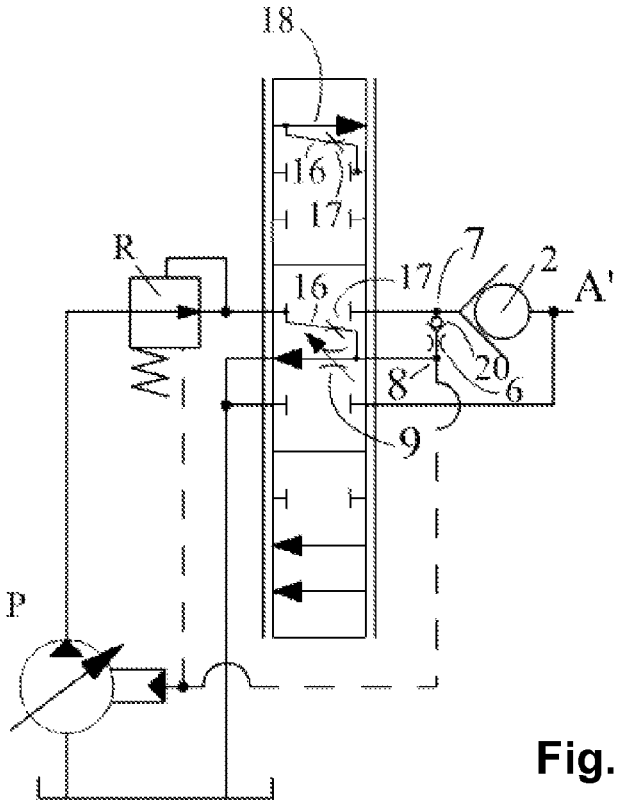
FIG. 8 shows a diagram of the specific embodiment that is shown in FIG. 7.

In FIGS. 6-8, an alternative valve device according to the invention is shown in a corresponding manner as the first valve device has been shown in the FIGS. 3-5. The alternative valve device differs in two features only, with respect to the first embodiment of the valve device, whereas mainly these features will be covered in the following description.

The first difference consists in that a third control conduit 16 including a third restrictor 17 is arranged to convey the regulator pressure $P_R$ that acts in the first connection point 3 between the pressure regulator R and the flow regulating valve F to the third connection point 8.

The second difference consists in that a second non-return valve 20 is arranged in the second control conduit 5 in order to prevent a flow from the outlet of the flow regulating valve F to the third connection point 8, via the second connection point 7. Hence, the second non-return valve 20 opens towards the second connection point 7 and conveys a flow in parallel with the flow regulating valve F when the control pressure $P_C$ at the third connection point 8 is greater than the load pressure $P_L$ at the second connection point 7.

This gives advantages in systems with great inertia, such as e.g. when a swinging arm or crane beam is to be moved. When the flow regulating valve F opens in order to let through a flow it will in a conventional valve device initially take a very high pressure to overcome the inertia of the crane beam and make it move. However, as the crane beam works up a velocity the necessary pressure will decrease. The control pressure that is conveyed to the pump will in a conventional system however remain elevated due to the fact that the flow that the pump delivers is much greater than that the cylinder chamber may receive. Hence, a flow will go under a very high pressure to the tank, which flow corresponds to an energy loss. In the invention according to the second embodiment, a flow will instead go from the first connection point 3, via the third and second connection points 8 and 7, respectively, to the motor port connection A', with very low pressure losses as a consequence. At the same time a lower pressure $P_C$ will be conveyed to the pressure regulator R and the pump P, which hence may operate at a lower pressure level.

In FIG. 7, an alternative embodiment of the valve device 1 is shown, in which the third control conduit 16 consists of a through hole that connects the first connection point 3 with the third connection point 8. Centrally on the third control conduit 16 a connection to the second control conduit 6 is provided, which includes a second non-return valve 20 that opens towards the second connection point 7. Hence, with respect to the diagram in FIG. 6 there is a difference, but with respect to the strict functionality there is no difference.

The connection point 8, which in FIG. 6 is illustrated by a dot, may in FIG. 7 instead be said to be constituted by the part of the third control conduit 16 that is located downstream of the third restrictor 17 and is in connection with the first restrictor 6. Generally, the shown diagrams are simplifications that only show parts that are relevant for the invention and above all, the connection points are theoretical points that in practice may be constituted by a part of a conduit or the like.

In FIG. 8, a second diagram of the alternative valve device 1 is shown. The difference in this diagram with respect to the diagram that is shown in FIG. 5 is hence the same as the differences between FIGS. 7 and 4, i.e. the third control conduit 16 that includes a third restrictor 17 and a second non-return valve 20. The third control conduit 16 is not represented in the second open position, i.e. when the valve spool has been displaced upwards, since in this position it is without function.

The invention claimed is:

1. A hydraulic valve device including:

a high pressure connection and a low pressure connection;

at least one motor port connection which is connectable to a motor port on a hydraulic motor;

a flow regulating valve, which is arranged between the high pressure connection and the motor port connection and which includes a flow opening that is adjustable between a fully closed position and a fully open position;

a pressure regulator, which is arranged between the high pressure connection and the flow regulating valve, wherein a regulator pressure acting at a first connection point between the pressure regulator and the flow regulating valve via a first control conduit acts on the pressure regulator in order to close the same, a second control conduit including a first restrictor, which control conduit is arranged to convey a load pressure that acts at the motor port connection from a second connection point positioned between the flow regulating valve and the motor port connection via the first restrictor to a third connection point where a first control pressure acts and which third connection point is in connection with the pressure regulator in order to act on the same in the opening direction with said first control pressure, wherein the third connection point is connected to the low pressure connection, via an adjustable second restrictor, a third control conduit including a constantly open third restrictor which is arranged in order to convey the regulator pressure acting at the first connection point between the pressure regulator and the flow regulating valve via the third restrictor to said third connection point, and the third control conduit, which is in the form of a though hole in a valve spool of the flow regulating valve, connects the first connection point with the third connection point such that there will always be a flow through the third control conduit, independent of the position of the valve spool of the flow regulating valve.

2. Hydraulic valve device according to claim 1, wherein a non-return valve is arranged between the second connection point and the third connection point, which non-return valve opens towards the second connection point in order to convey a flow in parallel with the flow regulating valve when the control pressure at the third connection point is greater than the load pressure at the second connection point.

3. Hydraulic valve device according to claim 1, wherein the adjustable second restrictor is regulated in dependence of the flow regulating valve.

4. Hydraulic valve device according to claim 3, wherein the adjustable second restrictor is regulated such that the flow through the second restrictor decreases when the flow through area of the opening of the flow regulating valve towards the motor port connection is increased.

5. Hydraulic valve device according to claim 1, wherein the adjustable second restrictor is arranged to be electrically regulated.

6. Hydraulic valve device according to claim 1, wherein a spring is arranged to constantly act on the pressure regulator in order to open the same.

7. A hydraulic valve device comprising:

a valve housing having a high pressure connection, low pressure connection and a motor port connection connectable to a motor port on a hydraulic motor;

a flow regulating valve being arranged in the housing between the high pressure connection and the motor port connection and including a flow opening adjustable between a fully closed position and a fully open position;

a pressure regulator arranged in the housing between the high pressure connection and the flow regulating valve such that a regulator pressure acting at a first connection point between the pressure regulator and the flow regulating valve via a first control conduit acts on the pressure regulator to close the pressure regulator;

a second control conduit including a first restrictor, the second control conduit being arranged to convey a load pressure acting at the motor port connection from a second connection point positioned between the flow regulating valve and the motor port connection via the first restrictor to a third connection point where a first control pressure acts, the third connection point being connected in fluid communication with the pressure regulator to act on the pressure regulator in the opening direction with the first control pressure, the third connection point being connected in fluid communication with the low pressure connection via an adjustable second restrictor; and a third control conduit including a constantly open third restrictor arranged to convey the regulator pressure acting at the first connection point between the pressure regulator and the flow regulating valve via the third restrictor to the third connection point, the third control conduit being constantly open and being a though hole in a valve spool of the flow regulating valve and connecting the first connection point with the third connection point such that there will always be a flow through the third control conduit, independent of the position of the valve spool of the flow regulating valve.

8. A hydraulic valve device according to claim 7, wherein a non-return valve is arranged between the second connection point and the third connection point, the non-return valve opening towards the second connection point to convey a flow in parallel with the flow regulating valve when the control pressure at the third connection point is greater than the load pressure at the second connection point.

9. A hydraulic valve device according to claim 7, wherein the adjustable second restrictor is regulatable dependent on the flow regulating valve.

10. A hydraulic valve device according to claim 9, wherein the adjustable second restrictor is regulatable such that flow through the second restrictor decreases when a flow through area of an opening of the flow regulating valve towards the motor port connection is increased.

11. A hydraulic valve device according to claim 7, wherein the adjustable second restrictor is electrically regulatable.

12. A hydraulic valve device according to claim 7, wherein a spring is arranged to constantly act on the pressure regulator to open the pressure regulator.

* * * * *